US007568695B2

(12) United States Patent
Yasukawa et al.

(10) Patent No.: US 7,568,695 B2
(45) Date of Patent: Aug. 4, 2009

(54) SHEET FEEDER AND JAM DETECTING METHOD

(75) Inventors: Ryoichi Yasukawa, Kahoku (JP); Minoru Masuda, Kahoku (JP); Satoshi Ishida, Kahoku (JP); Noriaki Yamazaki, Kahoku (JP)

(73) Assignee: PFU Limited, Ishikawa (JP)

( * ) Notice: Subject to any disclaimer, the term of this patent is extended or adjusted under 35 U.S.C. 154(b) by 170 days.

(21) Appl. No.: 11/331,063

(22) Filed: Jan. 13, 2006

(65) Prior Publication Data

US 2006/0159470 A1 Jul. 20, 2006

(30) Foreign Application Priority Data

Jan. 14, 2005 (JP) ..... P2005-007319

(51) Int. Cl.
*B65H 7/02* (2006.01)

(52) U.S. Cl. ..... 271/228; 271/227

(58) Field of Classification Search ..... 271/226, 271/227, 228

See application file for complete search history.

(56) References Cited

U.S. PATENT DOCUMENTS 4,944,505 A * 7/1990 Sherman, III ..... 271/265.03
4,971,304 A * 11/1990 Lofthus ..... 271/227
5,169,140 A * 12/1992 Wenthe, Jr. ..... 271/228
5,443,257 A * 8/1995 Sakamori ..... 271/228
5,662,321 A * 9/1997 Borostyan et al. ..... 271/10.03
5,697,608 A 12/1997 Castelli et al.
6,168,153 B1 * 1/2001 Richards et al. ..... 271/227
6,578,844 B2 * 6/2003 Acquaviva et al. ..... 271/228
6,779,971 B2 * 8/2004 Garrett ..... 415/156

FOREIGN PATENT DOCUMENTS

| | | |
|---|---|---|
| GB | 2 287 457 | 9/1995 |
| JP | 5-170376 | 7/1993 |
| JP | 3197029 | 6/2001 |
| JP | 3467144 | 8/2003 |

OTHER PUBLICATIONS

German Office Action issued Mar. 16, 2007 issued with corresponding German Published Patent Application No. 10 2006 001 702.1.

* cited by examiner

*Primary Examiner*—Kaitlin S Joerger
(74) *Attorney, Agent, or Firm*—Staas & Halsey LLP

(57) ABSTRACT

A transporter is adapted to transport a sheet in a first direction. At least three detectors are disposed at a downstream side of the transporter in the first direction. Each of the detectors is operable to detect passing time of a leading end edge of the sheet. A processor is operable to calculate: a first angle of the sheet with respect to the first direction based on a first difference of the passing time detected by first two of the detectors and a first distance between the first two of the detectors; and a second angle of the sheet with respect to the first direction based on a second difference of the passing time detected by second two of the detectors and a second distance between the second two of the detectors, and operable to detect a jam in case that a value of an angular difference between the first angle and the second angle is larger than a prescribed value.

8 Claims, 5 Drawing Sheets

SHEET FEEDER AND JAM DETECTING METHOD

BACKGROUND OF THE INVENTION

The present invention relates to a sheet feeder and a jam detecting method in which a jam resulting from a feed of unstapled media with leading end bent corners or stapled media is detected at an early stage thereof to stop the feed, so as to suppress a damage that is to be made to the sheets.

A related sheet feeder used in an image reader takes out sheets of paper sheet by sheet. In a case where there are a plurality of sheets of document to be read, the plurality of sheets of document are set in piles, and a pick roller rotates in such a manner as to pick a sheet of document to feed it into the feeder, whereby only a sheet of document on the top of the pile of sheets of document is picked so as to be fed into a main body of the feeder. As this occurs, even in the event that a plurality of stapled sheets of document are carelessly set as stapled, since the feeder is designed to function to separate and feed the sheets of document so set individually, there has existed a problem that the sheets of document are damaged or crooked to thereby generate a jam.

There is an art in which metallic components are detected by means of a magnetic sensor during transport of sheets of document in order to detect stapled media in a sheet feeder (refer to JP-A-5-170376). However, there are still problems with narrow detecting ranges and that staples other than metallic ones and jams due to bent corners cannot be detected.

In addition, there is an art which detects a skew pressure that is generated due to the holding force by a staple or staples and the separating action, and a loop that is generated by the separating action (refer to Japanese Patent No. 3197029). However, since the skew pressure varies depending on thicknesses of paper, there are caused problems that only a specific medium can be detected and that since no loop is formed with a medium with a bent corner, the medium cannot be detected.

Additionally, there is an art which detects a lifting force generated at a trailing end of a sheet when it is attempted to be separated from a batch of stapled sheets (refer to Japanese Patent No. 3467144). However, the detection is implemented only at the trailing end of sheets, and hence there are caused problems that the detection cannot be implemented with a batch of sheets of different sizes and that jams due to bent corners cannot be detected.

In addition, while there is an art of implementing a skew detection, there is presented a problem that a sheet that is set askew in advance is detected.

SUMMARY

It is therefore an object of the invention is to provide a sheet feeder which enables an accurate detection of jams that are caused by bent corners and staples even when sheets of different sizes and thickness are set in a mixed fashion.

In order to achieve the object, according to the invention, there is provided a sheet feeder comprising:

a transporter, adapted to transport a sheet in a first direction;

at least three detectors, disposed at a downstream side of the transporter in the first direction, each of the detectors operable to detect passing time of a leading end edge of the sheet; and a processor, operable to calculate:

a first angle of the sheet with respect to the first direction based on a first difference of the passing time detected by first two of the detectors and a first distance between the first two of the detectors; and a second angle of the sheet with respect to the first direction based on a second difference of the passing time detected by second two of the detectors and a second distance between the second two of the detectors, and operable to detect a jam in case that a value of an angular difference between the first angle and the second angle is larger than a prescribed value.

The at least three detectors may be aligned in a second direction perpendicular to the first direction.

The processor may disregard one of the passing time that is first detected by one of the detectors.

One of the first two of the detectors may be identical with one of the second two of the detectors, and correspond to a center position of the sheet in a second direction perpendicular to the first direction.

According to the invention, there is also provided a sheet feeder comprising:

a transporter, adapted to transport a sheet in a first direction, and including a measurer that is operable to measure displacement of the sheet in the first direction;

at least three detectors, disposed at a downstream side of the transporter in the first direction, each of the detectors operable to detect passing time of a leading end edge of the sheet; and a processor, operable to calculate:

a first angle of the sheet with respect to the first direction based on the displacement between two of the passing time detected by first two of the detectors and a first distance between the first two of the detectors; and a second angle of the sheet with respect to the first direction based on the displacement between two of the passing time detected by second two of the detectors and a second distance between the second two of the detectors, and operable to detect a jam in case that a value of an angular difference between the first angle and the second angle is larger than a prescribed value.

The at least three detectors may be aligned in a second direction perpendicular to the first direction.

According to the invention, there is also provided a jam detecting method for a sheet feeder that includes a transporter adapted to transport a sheet in a first direction, and at least three detectors disposed at a downstream side of the transporter in the first direction, the method comprising:

detecting passing time of a leading end edge of the sheet by each of the detectors;

calculating a first angle of the sheet with respect to the first direction based on a first difference of the passing time detected by first two of the detectors and a first distance between the first two of the detectors, calculating a second angle of the sheet with respect to the first direction based on a second difference of the passing time detected by second two of the detectors and a second distance between the second two of the detectors, and detecting a jam in case that a value of an angular difference between the first angle and the second angle is larger than a prescribed value.

According to the invention, there is also provided a jam detecting method for a sheet feeder that includes a transporter adapted to transport a sheet in a first direction and including a measurer that measurers displacement of the sheet in the first direction, and at least three detectors disposed at a downstream side of the transporter in the first direction, the method comprising:

detecting passing time of a leading end edge of the sheet by each of the detectors;

calculating a first angle of the sheet with respect to the first direction based on the displacement between two of the passing time detected by first two of the detectors and a first distance between the first two of the detectors;

calculating a second angle of the sheet with respect to the first direction based on the displacement between two of the passing time detected by second two of the detectors and a second distance between the second two of the detectors; and detecting a jam in case that a value of an angular difference between the first angle and the second angle is larger than a prescribed value.

According to the invention, an accurate detection of jams that are caused by bent corners and staples is made possible, even when sheets of different sizes and thickness are set in a mixed fashion.

DETAIL DESCRIPTION OF PREFERRED EMBODIMENTS

Figure 1:
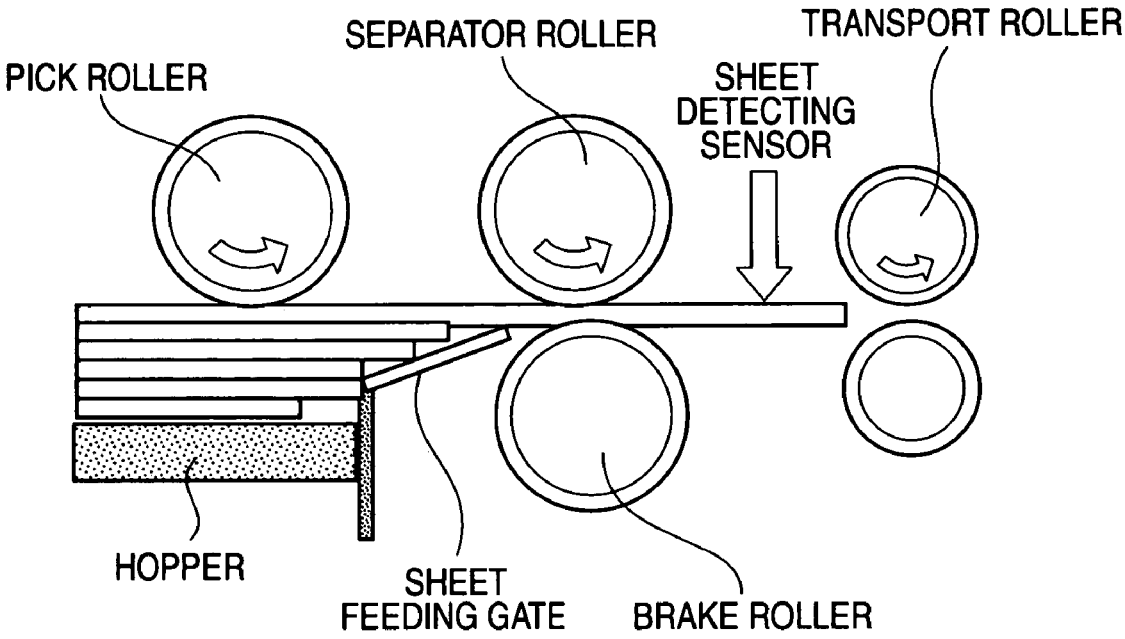
FIG. 1 is a diagram which illustrates a sheet feeder for use with an imager reader.

Hereinafter, the invention will be described based on an embodiment. A sheet feeder is, for example, used in an image reader. As shown in FIG. 1, a pick roller is provided at an end portion of a hopper on which sheets are stacked so as to pick the sheets stacked on the hopper from the top thereof to transport them into the feeder. As this occurs, while there occurs a case where not only a single sheet on the top of the pile of sheets but also a few sheets from the top of the pile are transported at the same time, the number of sheets to be fed into the feeder is restricted by regulating the thickness of a passable sheet by a feeding gate, and furthermore, only a sheet is separated from the pile by means of a separator roller and a brake roller so as to be fed into the feeder. A sheet detecting sensor is such as to detect a sheet which passes through the position at which the sensor is disposed.

Figure 2:
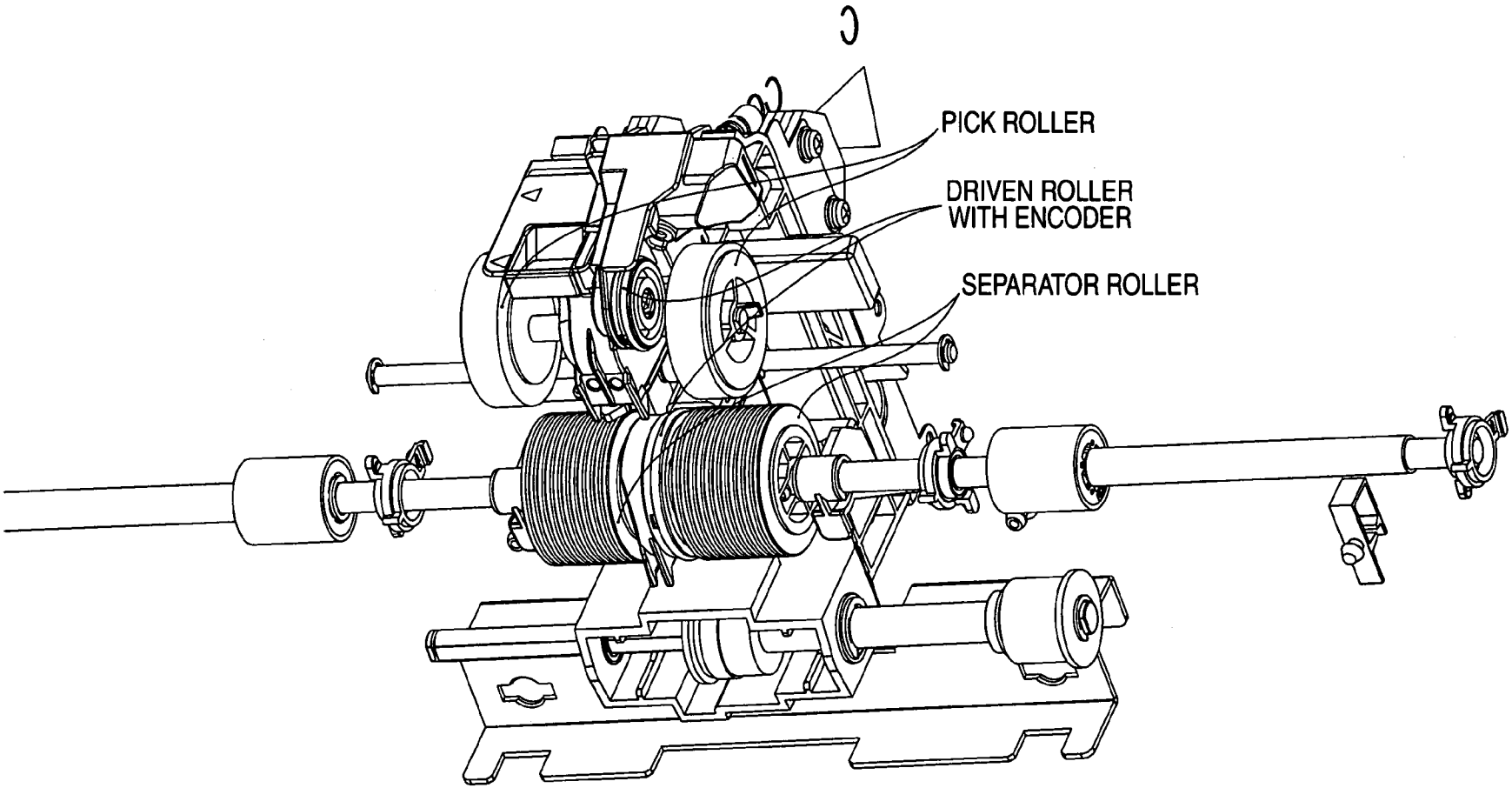
FIG. 2 is a diagram of a pick roller and a separator roller as viewed from a sheet contacting side.

The pick roller and the separator roller are driven by a motor. In a separating section, a device which detects an actual sheet displacement is provided. In each of the pick roller and the separator roller as shown in FIG. 2, two axially divided rollers are fixed on an identical drive shaft. A driven roller with an encoder is provided between the two divided separator rollers in such a manner as to be brought into contact with a sheet being fed so as to rotate in response to the movement of the sheet. No load is applied to the driven roller, and the driven roller is supported in such a manner as to freely rotate about the drive shaft of the separator rollers. The driven roller use a roller with a small rotating load which contacts a sheet with a smaller pressure than a sheet pressure that is imparted to the sheet by a transport means (the separator rollers) to thereby rotate while following the sheet and rotates while following a dimensional change in the transport means and a change in environment temperature, and a sheet contact height which varies depending on shapes of sheets.

By providing the encoder which detects the rotational speed of the driven roller, the actual sheet displacement at the separating section can be calculated from the roller rotational speed and roller diameter.

Figure 3:
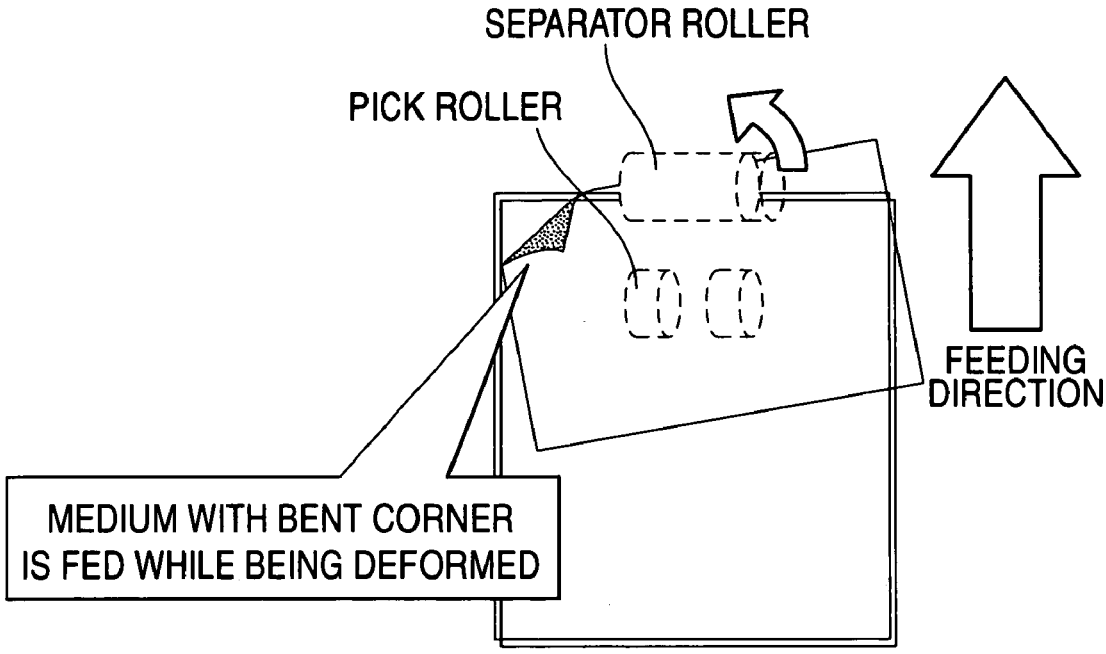
FIG. 3 is a diagram which explains the principle of a jam detection according to the invention.

As shown in FIG. 3, in a case where unstapled media with a bent corner or a batch of stapled media is fed, to pay attention to a behavior of a separated sheet at a leading end thereof, in the case of a sheet of thick paper, skews are accumulated, whereas, in the case of a sheet of thin paper, a leading end edge deforms, and in either of the cases, the skew angle of the leading end edge varies largely depending on locations of the leading end edge. Consequently, a jam can be determined on by a difference in skew angle at the locations of the leading end edge of a sheet that has just been separated.

Figure 4:
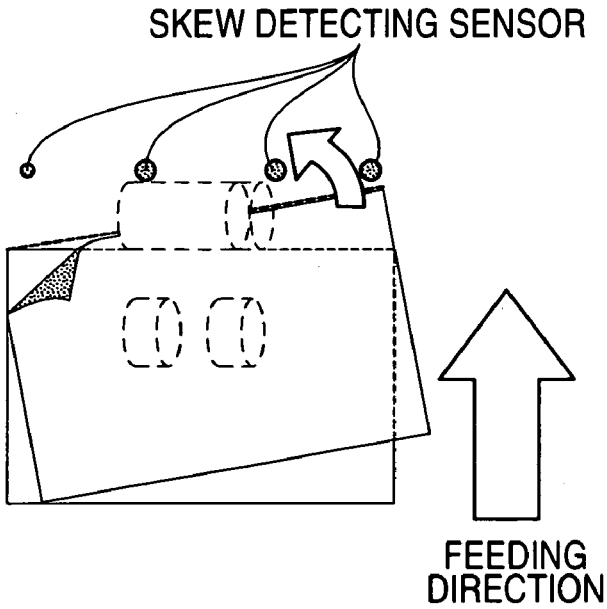
FIG. 4 is a conceptual diagram which illustrates an arrangement of skew detecting sensors.

As shown in FIG. 4, a plurality of or at least three or more skew detecting sensors (four are illustrated in FIG. 4) are aligned in a straight line in a direction parallel with a width of the sheet which is perpendicular to a sheet moving direction (a feeding direction) at right angles at a position immediately behind the sheet separating section.

Thus, the skew detecting sensors are aligned in parallel at the downstream side of the separating section in the feeding direction, whereby a skew angle is obtained from a difference in passing time of a leading end edge of a sheet, which is time when the leading end edge of the sheet passes through, between the adjacent skew detecting sensors and a dimension at which the skew detecting sensors are aligned (a distance between the skew detecting sensors) by a processor that is not shown in the drawings. The skew detecting sensors are each a sensor for detecting a passage of an end edge of a sheet. When an angular difference between a plurality of leading end skew angles obtained exceeds a normal value, it is understood that the rotation and deformation of the sheet is large, so that a jam is determined on by the processor. In the event that a jam is not determined on, when further detecting sensors are provided, a similar jam detection can continue to be carried out with respect to further sensor sections defined thereby.

Figure 5:
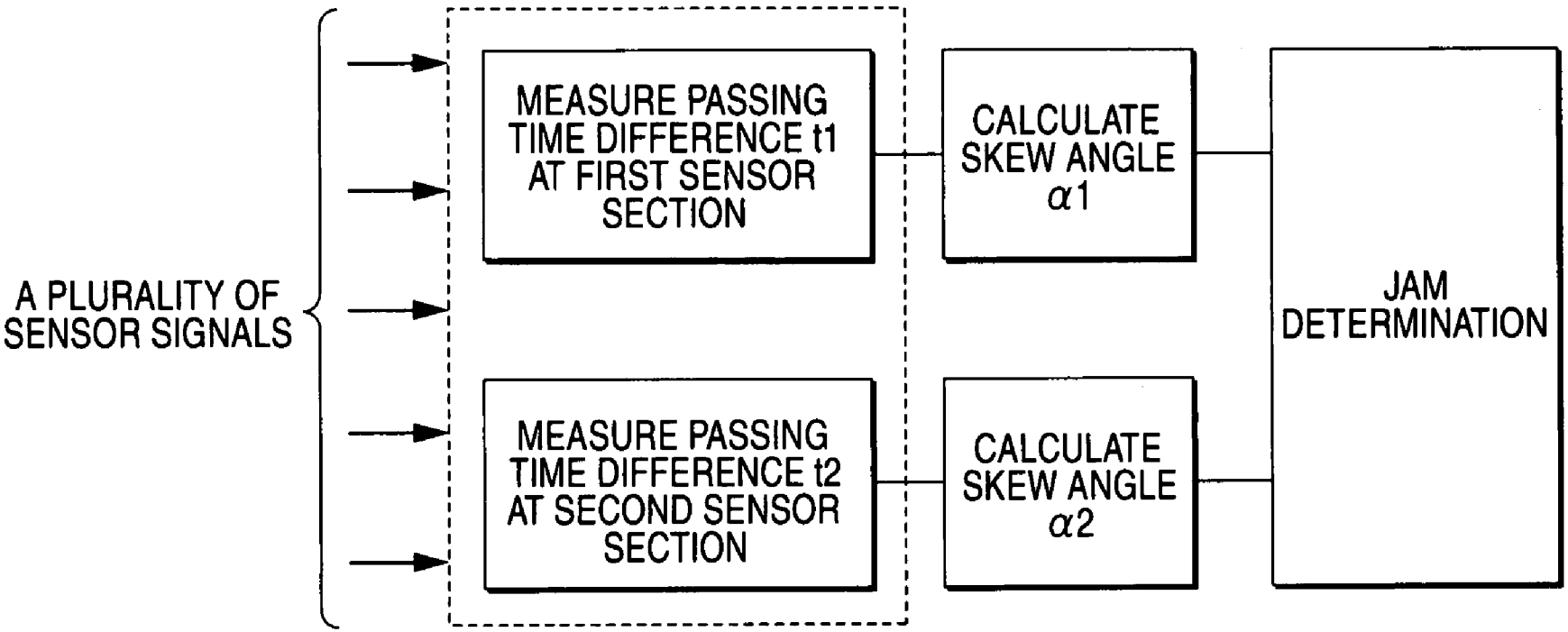
FIG. 5 is a schematic diagram which explains the configuration of the invention.

As shown in FIG. 5, a passing time difference t1 between two detecting sensors is measured at a first sensor section (a section defined between the two detecting sensors) by receiving inputs from the plurality of detecting sensors which are aligned in parallel. Similarly, a passing time difference t2 is measured at a second sensor section. Since a sheet feed per hour is known, a sheet displacement (a longitudinal distance) in which the sheet is transported during a time between the times so measured is obtained from the passing time differences. Furthermore, since the sensor section, that is, a distance between the the two detecting sensors (a transverse distance) is known, the skew angle is obtained as follows: skew angle $\alpha$=longitudinal distance/transverse distance, whereby skew angles $\alpha 1$, $\alpha 2$ are obtained from the passing time differences t1, t2.

Even in the event that a sheet is inclined relative to its moving direction when being set, when the sheet is being fed while left so inclined, although the skew angle is not zero, the angle is maintained, whereby the skew angle $\alpha 1=\alpha 2$. As this occurs, a jam is determined as not taking place. The invention is such that a jam can be determined on when $\alpha 2-\alpha 1>$prescribed value. In this case, there exists a large possibility that the sheet is rotated or deformed.

In FIG. 5, a section between the sensor which is the first in time to detect the leading end edge of the sheet and the sensor which is the second to detect the leading end edge of the sheet can be made as the first sensor section. Normally, both the sensors are adjacent to each other. The passing time difference t1 is measured between these two sensors, whereby the skew angle α1 is obtained. Similarly, thereafter, the skew angle α2 is obtained from the passing time difference t2 which is measured between any two of the sensors, for example, the second and third (or the first and third) skew detecting sensors, whereby when α2−α1>prescribed value, a jam can be determined on.

However, in the event that the sheet is being fed while largely inclined, there is possibility that an edge that is detected first is not a leading end edge of a sheet (a front side of a sheet in the sheet moving direction) but either of side edges thereof (sides lying on both sides of the sheet). In this case, it is not possible to determine whether the edge that is detected first by any of the detecting sensors is the leading end edge or the side edge. However, it is sure that an edge that is detected by the second detecting sensor, which is the second in time to detect, and detecting sensors thereafter is the leading end edge, whereby by disregarding the data detected first and using data detected by the second detecting sensors and detecting sensors thereafter, a jam can be determined on with no error by the skew amount of the leading end edge.

In addition, it is possible to specify the first and second sensor sections not by time sequence in which leading end edges are detected but by positions where leading end edges are detected. For example, in FIG. 5, specifying as first and second sensor sections two sensor sections which lie on both sides of the sensor disposed at a center of the aligned sensors, skew angles α1, α2 are obtained from passing time differences t1, t2 which are obtained in the aforesaid manner, respectively, in the sections lying on both the sides of the centered detecting sensor as a reference, and when a difference between the two skew angles>prescribed value, a jam can be determined on by the processor.

Furthermore, when the passing time difference between the detecting sensors due to a slippage of the sheet, an error is generated in calculation of a skew angle. To cope with this, instead of calculating a skew angle from the passing time difference, a skew angle is calculated from an actual sheet displacement at the feeding section by the processor.

To make this possible, the actual sheet displacement is detected by the driven roller equipped with the encoder (which can detect a rotating amount). By monitoring the rotating amount of the encoder, the actual sheet displacement can be measured, so that a skew angle can be calculated accurately from the actual sheet displacement so measured, even in the event that a difference in displacement between the transport means at the separating section and the sheet being fed is generated due to the slippage.

Figure 6:
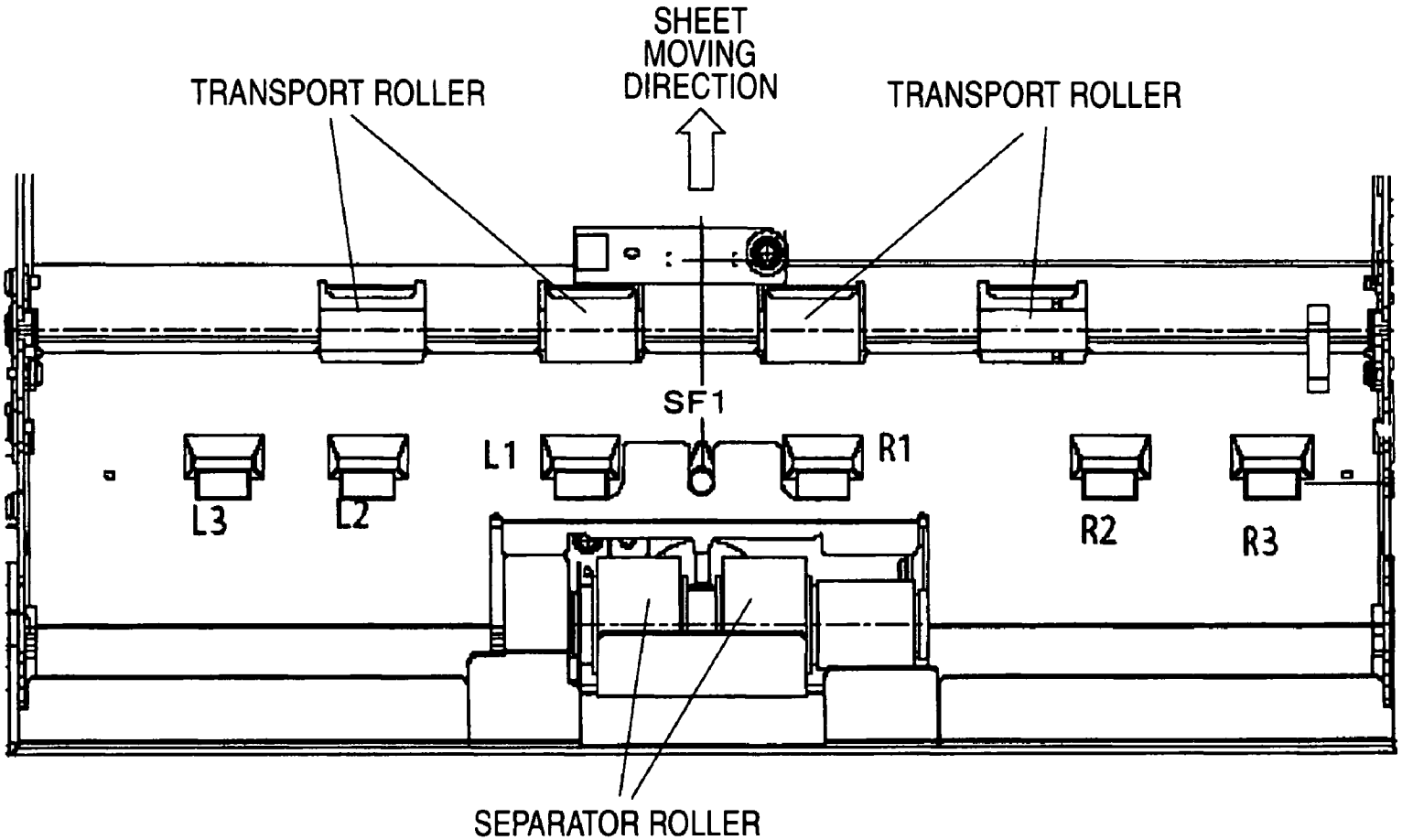
FIG. 6 is a diagram which illustrates an arrangement of the skew detecting sensors.

FIG. 6 corresponds to a view which results when the separator roller and transport rollers shown in FIG. 1 are viewed from the top thereof. Sheets are fed from a bottom to a top in the figure. A sensor SF1 corresponds to the sheet detecting sensor shown in FIG. 1. While sensors R1, R2, R3, L1, L2, L3 which are aligned in a straight line to both sides of the sensor SF1 are such as to be provided to detect sizes of sheets, these sheet size detecting sensors R1 to R3, L1 to L3 and the sheet detecting sensor SF1 can be made use of as skew detection sensors. As has been described above, according to the invention, a jam can be detected by using at least three of these detecting sensors.

What is claimed is:

1. A sheet feeder comprising:

a transporter, adapted to transport a sheet in a first direction;

at least three detectors, disposed at a downstream side of the transporter in the first direction, each of the detectors operable to detect passing time of a leading end edge of the sheet; and a processor, operable to calculate:

a first angle of the sheet with respect to the first direction based on a first difference of the passing time detected by first two of the detectors and a first distance between the first two of the detectors; and a second angle of the sheet with respect to the first direction based on a second difference of the passing time detected by second two of the detectors and a second distance between the second two of the detectors, and operable to detect a jam only when a value of an angular difference between the first angle and the second angle is larger than a prescribed value.

2. The sheet feeder according to claim 1, wherein the at least three detectors are aligned in a second direction perpendicular to the first direction.

3. The sheet feeder according to claim 1, wherein the processor disregards one of the passing time that is first detected by one of the detectors.

4. The sheet feeder according to claim 1, wherein one of the first two of the detectors is identical with one of the second two of the detectors, and corresponds to a center position of the sheet in a second direction perpendicular to the first direction.

5. A sheet feeder comprising:

a transporter, adapted to transport a sheet in a first direction, and including a measurer that is operable to measure displacement of the sheet in the first direction;

at least three detectors, disposed at a downstream side of the transporter in the first direction, each of the detectors operable to detect passing time of a leading end edge of the sheet; and a processor, operable to calculate:

a first angle of the sheet with respect to the first direction based on the displacement between two of the passing time detected by first two of the detectors and a first distance between the first two of the detectors; and a second angle of the sheet with respect to the first direction based on the displacement between two of the passing time detected by second two of the detectors and a second distance between the second two of the detectors, and operable to detect a jam only when a value of an angular difference between the first angle and the second angle is larger than a prescribed value.

6. The sheet feeder according to claim 5, wherein the at least three detectors are aligned in a second direction perpendicular to the first direction.

7. A jam detecting method for a sheet feeder that includes a transporter adapted to transport a sheet in a first direction, and at least three detectors disposed at a downstream side of the transporter in the first direction, the method comprising:

detecting passing time of a leading end edge of the sheet by each of the detectors;

calculating a first angle of the sheet with respect to the first direction based on a first difference of the passing time detected by first two of the detectors and a first distance between the first two of the detectors, calculating a second angle of the sheet with respect to the first direction based on a second difference of the passing time detected by second two of the detectors and a second distance between the second two of the detectors, and detecting a jam only when a value of an angular difference between the first angle and the second angle is larger than a prescribed value.

8. A jam detecting method for a sheet feeder that includes a transporter adapted to transport a sheet in a first direction and including a measurer that measurers displacement of the sheet in the first direction, and at least three detectors disposed at a downstream side of the transporter in the first direction, the method comprising:

detecting passing time of a leading end edge of the sheet by each of the detectors;

calculating a first angle of the sheet with respect to the first direction based on the displacement between two of the passing time detected by first two of the detectors and a first distance between the first two of the detectors;

calculating a second angle of the sheet with respect to the first direction based on the displacement between two of the passing time detected by second two of the detectors and a second distance between the second two of the detectors; and detecting a jam only when a value of an angular difference between the first angle and the second angle is larger than a prescribed value.

* * * * *